US007404559B2

(12) United States Patent
Yoshimura et al.

(10) Patent No.: US 7,404,559 B2
(45) Date of Patent: Jul. 29, 2008

(54) SHEET FEEDING APPARATUS WITH ULTRASONIC SENSOR FOR DETECTING MULTIPLE FEED OF PAPERS

(75) Inventors: Kazutoshi Yoshimura, Hachioji (JP); Kazumichi Yamauchi, Hachioji (JP); Akira Okamoto, Hino (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 445 days.

(21) Appl. No.: 11/050,785

(22) Filed: Feb. 7, 2005

(65) Prior Publication Data

US 2005/0275159 A1 Dec. 15, 2005

(30) Foreign Application Priority Data

Jun. 14, 2004 (JP) ..... 2004-175611

(51) Int. Cl.
*B65H 7/12* (2006.01)

(52) U.S. Cl. ..... 271/263; 271/262

(58) Field of Classification Search ..... 271/262, 271/263, 258.04, 265.04
See application file for complete search history.

(56) References Cited

U.S. PATENT DOCUMENTS 6,397,671 B1 * 6/2002 Nishio et al. ..... 73/159
6,739,591 B2 * 5/2004 Chujo et al. ..... 271/262
2003/0006550 A1 * 1/2003 Chujo et al. ..... 271/262
2004/0150155 A1 8/2004 Okitsu et al.

FOREIGN PATENT DOCUMENTS

JP 5-56851 7/1993
JP 2001-199595 7/2001

* cited by examiner

*Primary Examiner*—David H Bollinger
(74) *Attorney, Agent, or Firm*—Finnegan, Henderson, Farabow, Garrett & Dunner, L.L.P.

(57) ABSTRACT

Disclosed is a sheet feeding apparatus comprises: a multiple feed detecting section; a temperature detecting section; and a control section. The multiple feed detecting section has an ultrasonic transmitter and an ultrasonic receiver arranged on opposite sides of the conveyance path for conveying the sheets, and detects the feed of multiple sheets by, transmitting an ultrasonic wave from the ultrasonic transmitter to the ultrasonic receiver through at least one sheet traveling along the conveyance path, and comparing the ultrasonic wave received by the ultrasonic receiver with a reference level. The temperature detecting section detects a temperature of the apparatus, and the control section adjusts a detecting condition of the multiple feed detecting section based on the detected temperature.

20 Claims, 10 Drawing Sheets

EXAMPLE OF THE LAYOUT POSITION OF ULTRASONIC SENSOR

EXAMPLE OF THE CONFIGURATION OF A SHEET FEEDING APPARATUS AS A FIRST EMBODIMENT

TIMING FOR SWITCHING THE TRANSMISSION FREQUENCY
FIG. 6 ( A )
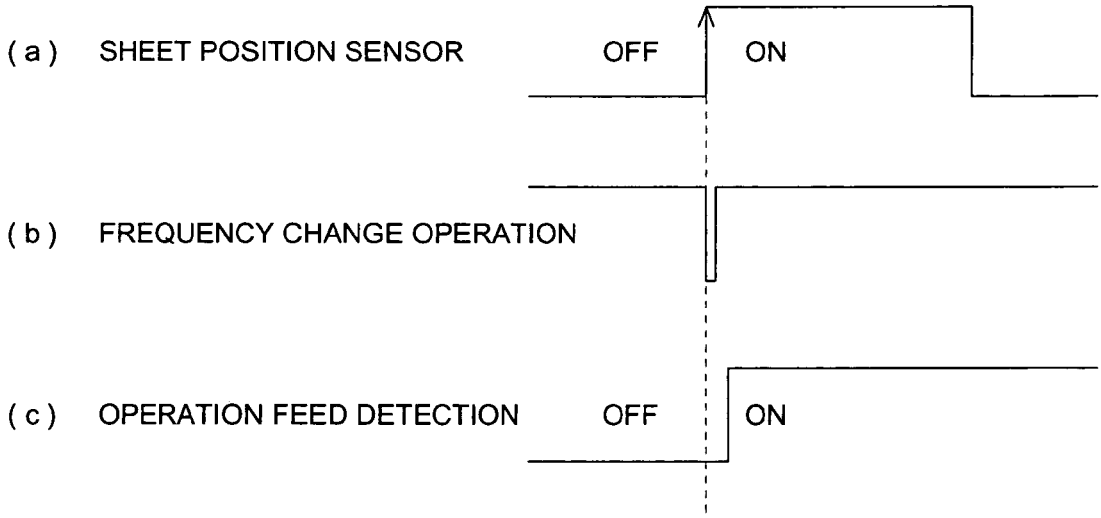
FIG. 6 ( B )
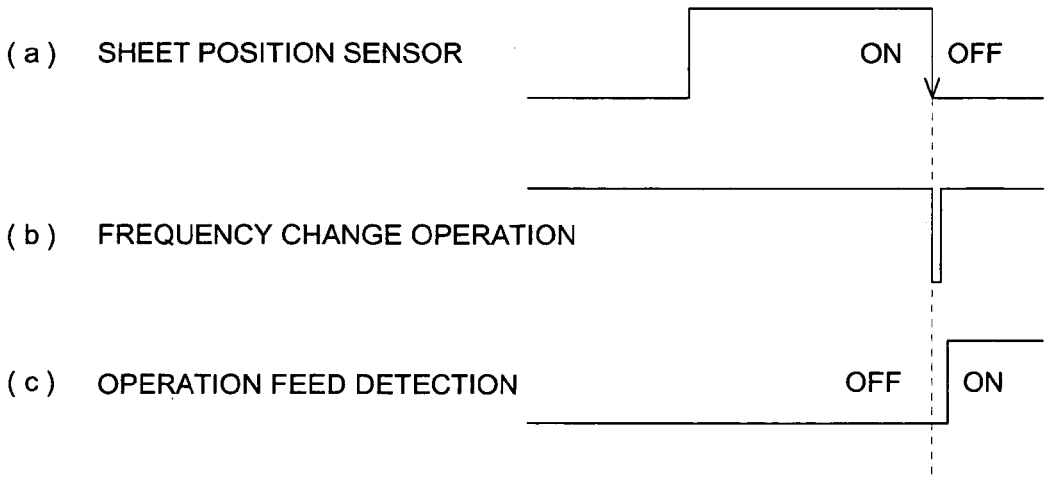

EXAMPLE OF OPERATION IN MULTIPLE FEED DETECTION BY SHEET FEEDING APPARATUS 100

EXAMPLE OF CONFIGURATION OF SHEET FEEDING APPARATUS 200 AS A SECOND EMBODIMENT

SHEET FEEDING APPARATUS WITH ULTRASONIC SENSOR FOR DETECTING MULTIPLE FEED OF PAPERS

BACKGROUND OF THE INVENTION

1. Field of the Invention

The present invention relates to a sheet feeding apparatus equipped with a multiple feed detecting section for detecting the feed of multiple sheets by using ultrasonic waves.

2. Description of Related Art

In the sheet feeding apparatus such as a copying machine and a multifunction peripheral (MFP), optical means have largely been used to detect the feed of multiple sheets of paper. Ultrasonic waves have been used in a facsimile machine and scanner as a new method in recent years.

For example, to improve the detecting accuracy of a multiple feed detecting device, such a device has been proposed that is capable of ensuring stable multiple sheet feed detection, wherein the intensity in the received signals of the ultrasonic wave is very small. Such a device is described, for example, in Japanese Utility Model Publication Jitsukaihei 5-56851.

In this case, the moving surface of an object to be detected is tilted with respect to the surface perpendicular to an ultrasonic wave propagation shaft composed of an ultrasonic transmitter and an ultrasonic wave receiver. Here, part of the ultrasonic wave emitted from the ultrasonic transmitter passes through the object to be detected, as in the conventional arrangement. Further, in this new arrangement, the ultrasonic wave reflected from the surface of the object to be detected travels in a different direction without going back to the transmitter. Thus, the ultrasonic wave does not form a standing wave between the transmitter and receiver, and the amount of the ultrasonic wave received by the receiver is kept almost constant, independently of the position, tilt angle or surface state of the object to be detected. This provides a very stable intensity of the signal received by the receiver, and ensures accurate detection of the feed of multiple sheets of paper, without the need of averaging the received signals.

Other types of multiple sheet feed detecting devices capable of improving the multiple sheet feed detecting accuracy by ultrasonic waves have also been proposed. One such example is the multiple sheet feed detecting device of Japanese Patent Publication Tokkai 2001-199595. In this case, two or more sheets of paper for multiple feed are deformed to provide a clearance area between them. The attenuation of the ultrasonic wave signal is improved by a layer of air in the clearance area, thus causing an improvement in the multiple feed detection accuracy.

When the ultrasonic wave type of multiple feed detecting devices, such as those described above, are used in the copying machine or MFP, however, the temperature will rise due to the fixing heat inside the copying or other machine. The temperature inside the machine will then subsequently decrease at the installation site after the machine has stopped operating. As a result, the transmission and reception sensitivity of the sensor will be reduced due to a drastic ambient temperature change and the temperature characteristics of the ultrasonic sensor itself. Further, when the sensitivity falls, the sensor may incorrectly determine that multiple sheets have been fed when only one has been fed. A decrease in the sensitivity of the sensor may become more problematic when the sensor is continuously driven.

For the reasons stated above, a multiple feed detecting device is currently used on the paper ejection part of a copying machine and multifunction machine. This arrangement, however, has a disadvantage in that a large volume of wasted paper is generated since detection of a multiple feed situation is done after the image has already been formed.

In view of the prior art described above, it is an object of the present invention to provide a novel sheet feeding apparatus equipped with a multiple feed detecting section for detecting the feed of multiple sheets by using ultrasonic waves. Further to this, it is an object of the present invention to provide a sheet feeding apparatus capable of ensuring stable multiple sheet feed detection with stable detection and accuracy. Moreover, it is an object of the invention to detect multiple sheet feeding even when the multiple detecting sensor itself or the installation site thereof, such as, for example, inside the copying machine experiences a drastic temperature change. It is an object of the invention that the sensitivity of the apparatus remains stable during temperature changes.

SUMMARY

To achieve at least one of the aforementioned objects, a first embodiment of a sheet feeding apparatus consistent with the present invention comprises: a multiple feed detecting section; a temperature detecting section; and a control section. The multiple feed detecting section has an ultrasonic transmitter and an ultrasonic receiver arranged on opposite sides of the conveyance path for conveying the sheets, and detects the feed of multiple sheets by, transmitting an ultrasonic wave from the ultrasonic transmitter to the ultrasonic receiver through at least one sheet traveling along the conveyance path, and comparing the ultrasonic wave received by the ultrasonic receiver with a reference level. The temperature detecting section detects a temperature of the apparatus, preferably a temperature of at least one of the ultrasonic transmitter and the ultrasonic receiver. The control section adjusts a detecting condition of the multiple feed detecting section based on the detected temperature.

According to another aspect of the first embodiment, the control section may change, based on the detected temperature, a transmission frequency of the ultrasonic transmitter of the multiple feed detecting section.

According to another aspect of the first embodiment, the control section may selectively set one of a plurality of predetermined transmission frequencies respectively corresponding to a plurality of temperature ranges, based on the detected temperature.

According to another aspect of the first embodiment, the control section may change the transmission frequency of the ultrasonic transmitter according to a continuous relationship between the transmission frequency and the temperature. The continuous relationship may be a linear relationship.

According to another aspect of the first embodiment, the apparatus preferably further includes a sheet position detecting section for detecting the position of the at least one sheet being conveyed, wherein the control section adjusts the transmission frequency based on the position detected by the sheet position detecting section. In this case, the control section may change the transmission frequency when the multiple feed detecting section is malfunctioning. The control section may adjust the transmission frequency at the start or end of a signal outputted from the sheet position detecting sensor.

According to another aspect of the first embodiment, based on the detected temperature, the control section may change the reference level. In this case, the control section may change the reference level according to a change in temperature with respect to an initial temperature.

According to another aspect of the first embodiment, the sheet feeding apparatus may further comprises an selecting section for selecting release of the multiple feed detection by the multiple feed detecting section.

According to a second embodiment consistent with the invention, a sheet feeding apparatus comprises: a multiple feed detecting section; a temperature detecting section; and an on/off operation control section. The multiple feed detecting section has an ultrasonic transmitter and an ultrasonic receiver arranged on opposite sides of the conveyance path for conveying the sheets, and detects the feed of multiple sheets by, transmitting an ultrasonic wave from the ultrasonic transmitter to the ultrasonic receiver through at least one sheet traveling along the conveyance path, and comparing the ultrasonic wave received by the ultrasonic receiver with a reference level. The temperature detecting section detects a temperature of the apparatus, preferably a temperature of at least one of the ultrasonic transmitter and the ultrasonic receiver. The on/off operation control section controls on/off operations of the multiple feed detecting section. The on/off operation control section turns off the multiple feed detecting section when the temperature detected by the temperature detecting section is outside a temperature range, preferably an operating range designed for the multiple feed detecting section.

According to another aspect of the second embodiment, the sheet feeding apparatus further comprises a notification section for notifying a user of the on/off status of the multiple feed detecting section.

BRIEF DESCRIPTION OF THE DRAWINGS

The accompanying drawings, which are incorporated in and constitute a part of this disclosure, illustrate various embodiments and aspects of the present invention. In the drawings:

FIG. 6 is a diagram representing an exemplary timing for switching the transmission frequency;

DETAILED DESCRIPTION OF PREFERRED EMBODIMENTS

The following description of an exemplary embodiment of a sheet feeding apparatus consistent with the present invention is made with reference to the accompanying drawings.

Figure 1:
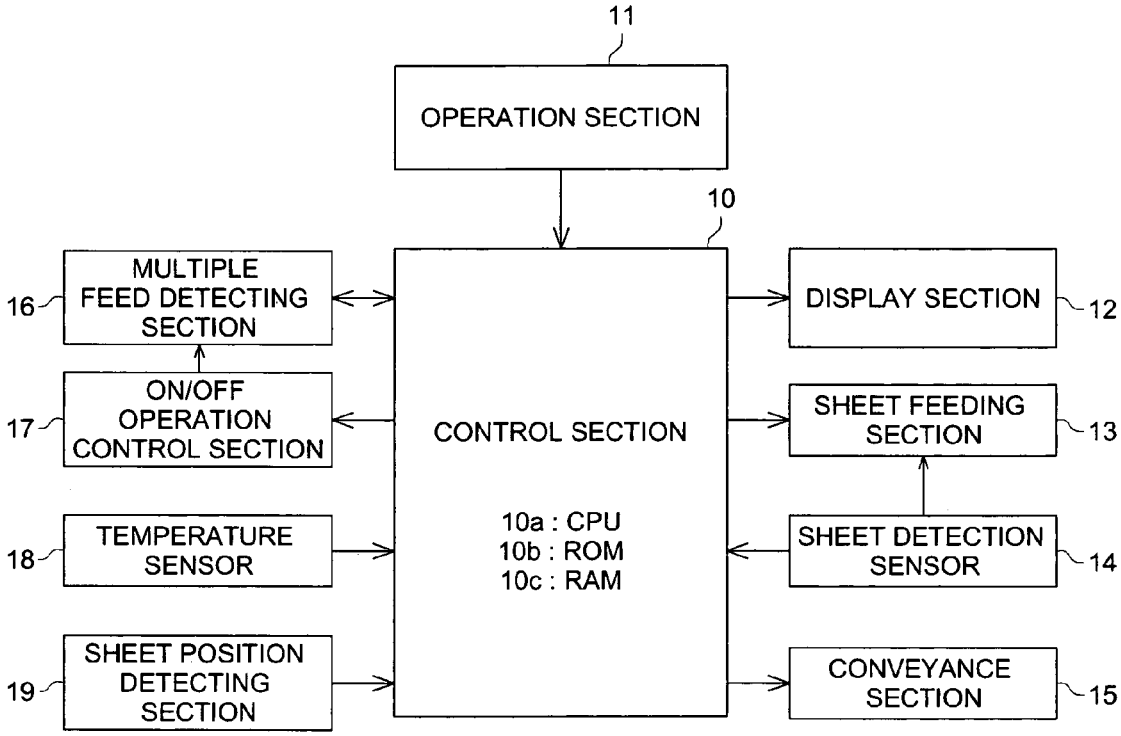
FIG. 1 is a drawing representing an example of the configuration of a sheet feeding apparatus 100 as a first embodiment of the present invention.

FIG. 1 is a drawing representing an example of the configuration of a sheet feeding apparatus 100 as an embodiment of the present invention. The sheet feeding apparatus 100 shown in FIG. 1 may be applied to a copying machine equipped with an electrophotographic copying function. Multiple feed may be detected prior to formation of an image on sheet, such as paper. Image formation control may thus be provided based on the detection of a multiple feed.

The sheet feeding apparatus 100 comprises a control section 10, an operation section 11, a display section 12, a sheet feeding section 13, a sheet detection sensor 14, a conveyance section 15, a multiple feed detecting section 16, a temperature sensor 18 and a sheet position detecting section 19.

The control section 10 is provided with a CPU 10*a*, ROM 10*b* and RAM 10*c*. Using the RAM 10*c* as a work memory area for the program stored in the ROM 10*b*, the CPU 10*a* may control the entire operation of the sheet feeding apparatus 100.

Based on the multiple feed detection information gained by the multiple feed detecting section 16, this control section 10 controls the conveyance section 15. For example, when the multiple sheet feed has been detected, the conveyance section 15 is controlled by the control section 10 in such a way as to form a predetermined image indicating the occurrence of multiple feed sheets and to eject sheets. At the same time, the control section 10 retains the image data intended to form an image for the sheets subjected to multiple feed, and controls the image forming section (FIG. 2 to be described later) so that an image is formed on the next sheet of paper conveyed by the conveyance section 15, in conformity to this image data. Further, when multiple sheets of paper have been fed, control is provided in such a way that the image formation operation is stopped after the multiple fed sheets have been ejected to a predetermined ejection tray, and a message is displayed on the display section 12 to notify that multiple sheets have been fed.

When detecting the feed of multiple sheets of paper, the control section 10 may change the transmission frequency of the ultrasonic transmitter based on the temperature detected by the temperature sensor 18.

The operation section 11 may be composed of, for example, a touch panel with liquid crystal display function. The operation section 11 serves as an interface for dialog with a user in, for example, a simplex mode, duplex mode or finishing mode. The paper size can also be set via section 11. The operation section 11 may output the operation information related to image information to the control section 10. Further, the operation section 11 may resume the operation of the image formation by the image forming section. When the feed of multiple sheets of paper has been detected by the multiple feed detecting section 16, section 11 may give an instruction to resume the image formation (e.g, via a conveyance operation), after temporarily stopping the paper feed upstream from the multiple feed detecting section 16.

The operation section 11 may also serve as a selecting device for selecting release of the multiple feed detection by the multiple feed detecting section 16. This configuration allows the user to operate the operation section 11 to release the multiple feed detection.

The display section 12 may display the settings and operation statuses at the time of image formation. Section 12 may include an LCD (liquid crystal display), for example. This display section 12 may display the message to the effect that multiple sheets have been fed. When the feed of multiple sheets of paper has been detected by the multiple feed detecting section 16, a message, such as an alarm mark, may be displayed to indicate that multiple sheets have been fed. This arrangement allows the user to confirm that multiple sheets have been fed, by observing the display section 12.

The display section 12 may also notify the user of the on/off status of the multiple feed detecting section 16. This configuration permits the user to confirm the on/off status of the multiple feed detecting section.

Despite of providing the display section 12 separate from the operation section 11, this section 12 may be substituted by the liquid crystal display function of the section 11.

Figure 2:
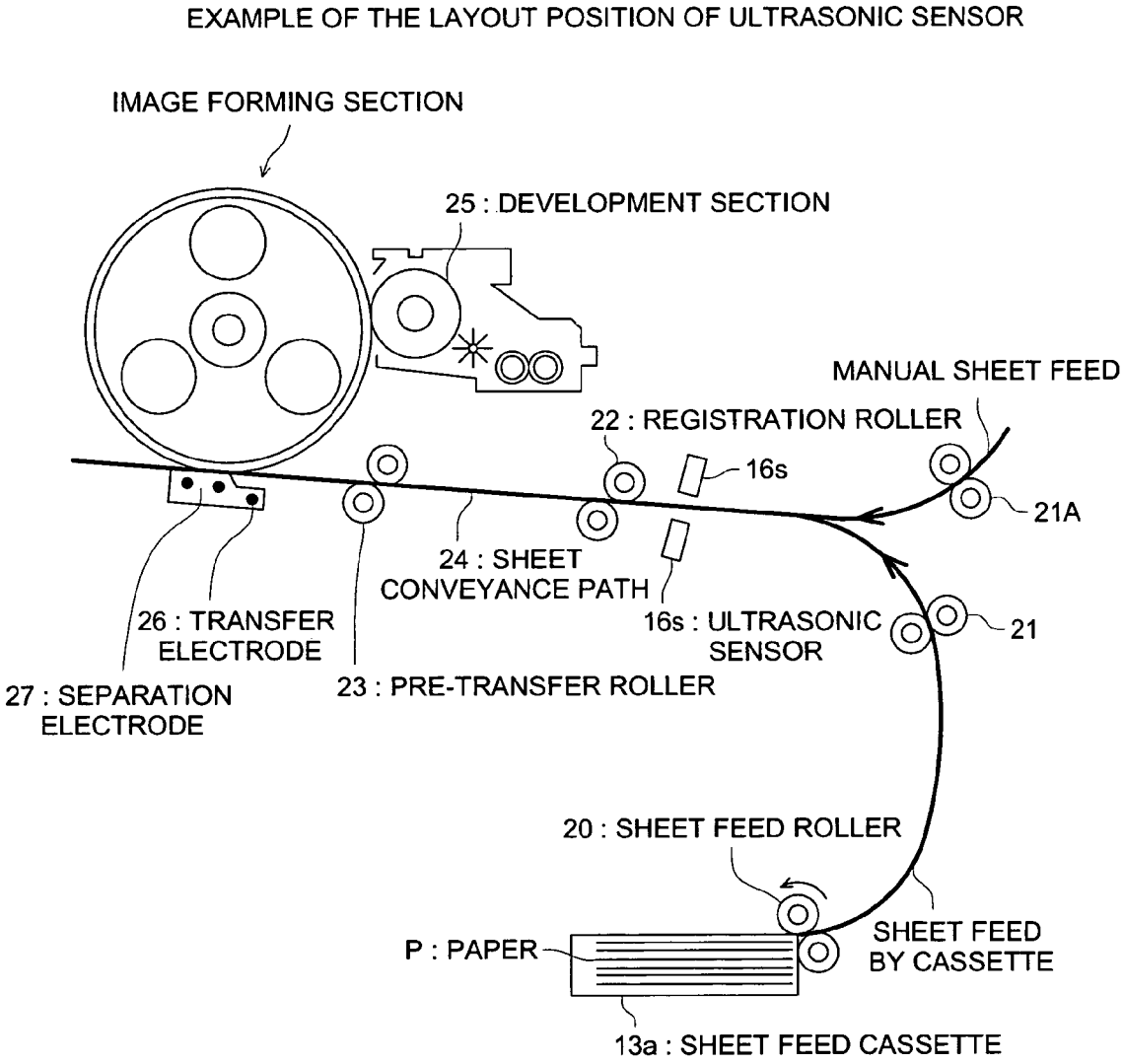
FIG. 2 is a diagram representing an example of the layout position of an ultrasonic sensor.

The sheet feeding section 13 may include a sheet feed tray (not illustrated) and a paper feed cassette (FIG. 2). As shown in FIG. 2, a plurality of sheets of paper P may be stored one on top of another in the sheet feed cassette 13*a*. Of these sheets of paper P, the topmost one may be in contact with a sheet feed roller 21. When this sheet feed roller 21 is rotated in the counterclockwise direction by a drive system (not illustrated), the topmost sheet of paper P may be ejected toward the position between a pair of registration rollers 22. Further, the sheet feeding section 13 may be equipped with a sheet detection sensor 14 to check if a sheet of paper P is present or not.

The conveyance section 15 may comprise a sheet feed roller 20, a conveyance roller 21, a registration roller 22, a pre-transfer roller 23, and a sheet conveyance path 24 for sheet of paper P (FIG. 2). The registration roller 22 may be mounted at a demarcation point between the first sheet feed and the second sheet feed in the conveying process of paper P. The registration roller 22 may be provided to ensure synchronization between conveyance start timing in the second sheet feed and transfer start timing in the image formation section. The image forming section may be equipped with a development section 25, a transfer electrode 26 and a separation electrode 27 (FIG. 2). This image forming section may form an image on the sheet of paper P conveyed by the conveyance section 15 after completing the process of rotating, enlarging, or reducing the image scanned by the image reader (not illustrated) of the copying machine.

The multiple feed detecting section 16 uses ultrasonic waves to detect the feed of multiple sheets of paper. The multiple feed detecting section 16 may be equipped with a ultrasonic sensor 16*s* having a ultrasonic transmitter and receiver. As shown in FIG. 2, the ultrasonic sensor 16*s* may be arranged on the sheet conveyance path 24 for conveying the paper located before the image forming section. Further, the configuration of the multiple feed detecting section 16 and detection of the feed of multiple sheets of paper are illustrated in FIG. 3.

Figure 3:
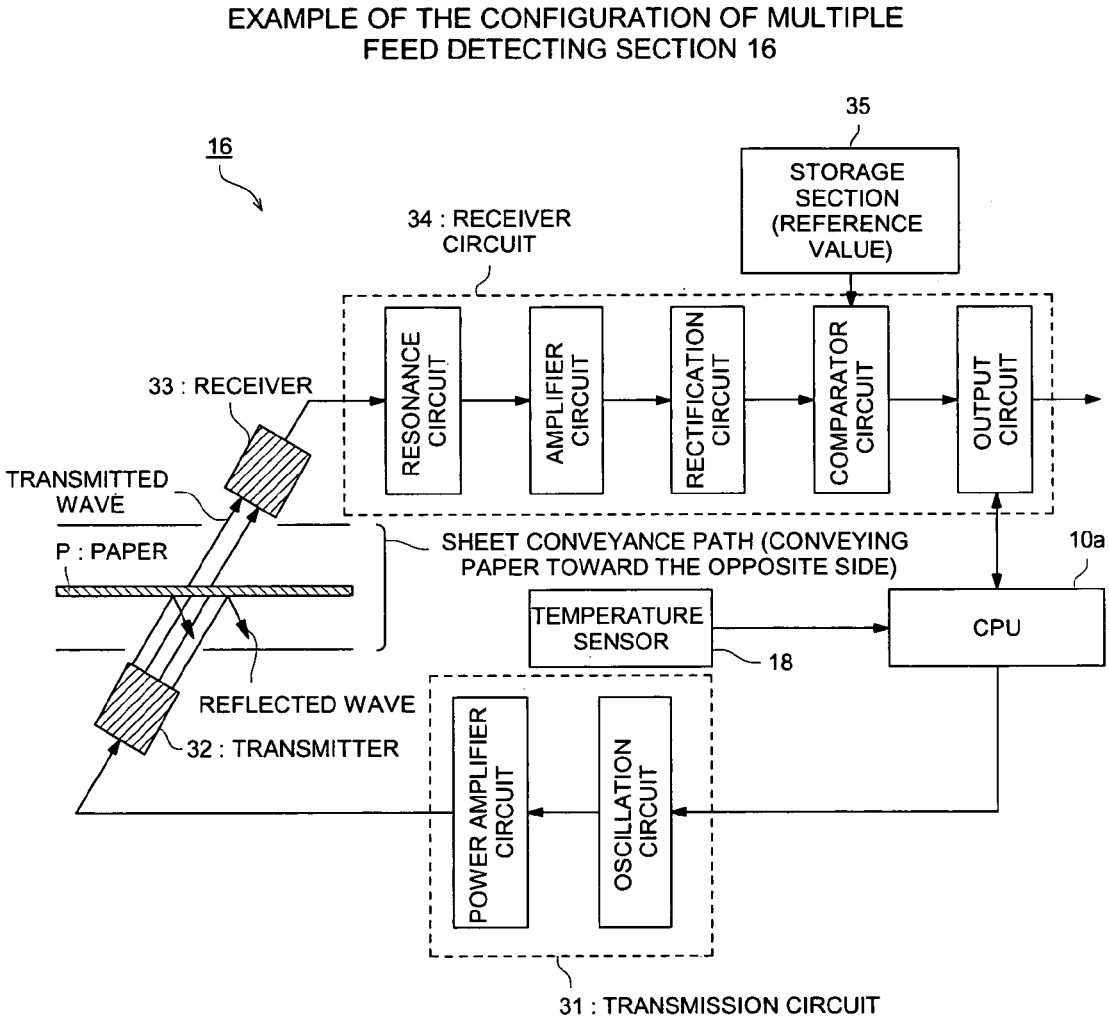
FIG. 3 is a diagram representing an example of the configuration of a multiple feed detecting section 16.

As shown in FIG. 3, the multiple feed detecting section 16 may be equipped with a transmission circuit 31, a transmitter 32, a receiver 33, a receiver circuit 34, and a storage section 35. The transmission circuit 31 may include an oscillation circuit for generating the predetermined frequency signal and a power amplification circuit for amplifying the predetermined signal. The receiver circuit 34 may be composed of a resonance circuit for converting oscillation energy into electric signals, an amplifier circuit for amplifying the received signal, a rectification circuit for rectifying the amplified signal, a comparator circuit for comparing the received signal with the reference value, and an output circuit for outputting the signal from the comparator circuit.

The electric signal of predetermined frequency outputted from the transmission circuit 31 may be inputted into the transmitter 32 and converted into the acoustic energy by the transducer (piezoelectric device) in the transmitter 32. It may then be radiated to the receiver 33 via the sheet of paper P. The ultrasonic wave discharged from the transmitter is partly reflected from the sheet of paper P located on the transport path. The ultrasonic wave passing through the sheet of paper P is received by the receiver 33 and converted into the electric signal by the transducer (piezoelectric device) in the receiver 33. It may then be inputted into the receiver circuit 34. Based on the attenuation after one sheet of paper and the multiple sheets have been fed and the reference value stored in the storage section 35, the receiver circuit 34 may check if multiple sheets of paper have been fed or not. The RAM 10*c* may be used as a storage section 35 to store the reference value.

The control section 10 of FIG. 1 may further include an on/off operation control section 17 for controlling the on/off operation of the multiple feed detecting section 16. For example, when the temperature detected by the temperature sensor 18 is not in the range of the operating temperature of the multiple feed detecting section 16, the on/off operation control section 17 turns off the multiple feed detecting section 16. Further, if the detected temperature is within the range of the operation temperature of the multiple feed detecting section 16, the on/off operation control section 17 may turn on the multiple feed detecting section 16.

As noted, the sheet feeding apparatus 100 is provided with the temperature sensor 18. This temperature sensor 18 may be arranged close to the ultrasonic sensor 16*s* inside the sheet feeding apparatus 100 and is designed to measure the temperature. The temperature detection signal from the temperature sensor 18 may be supplied to the control section 10. Based on the detected temperature, the control section 10 may provide control in such a way as to change the transmission frequency of the transmitter 32. It is also possible to make such arrangements that the temperature sensor 18 is mounted on the surface of the transmitter 32 of the ultrasonic sensor 16*s* or the receiver 33, thereby measuring the respective surface temperature directly.

Transmission frequency may be controlled in two methods: (1) a stepwise method, where a respective predetermined transmission frequency is set for each of a plurality of temperature ranges specified by one or more threshold values; and (2) a linear method, where the relationship between the temperature and frequency are linearly dependent.

Figure 4:
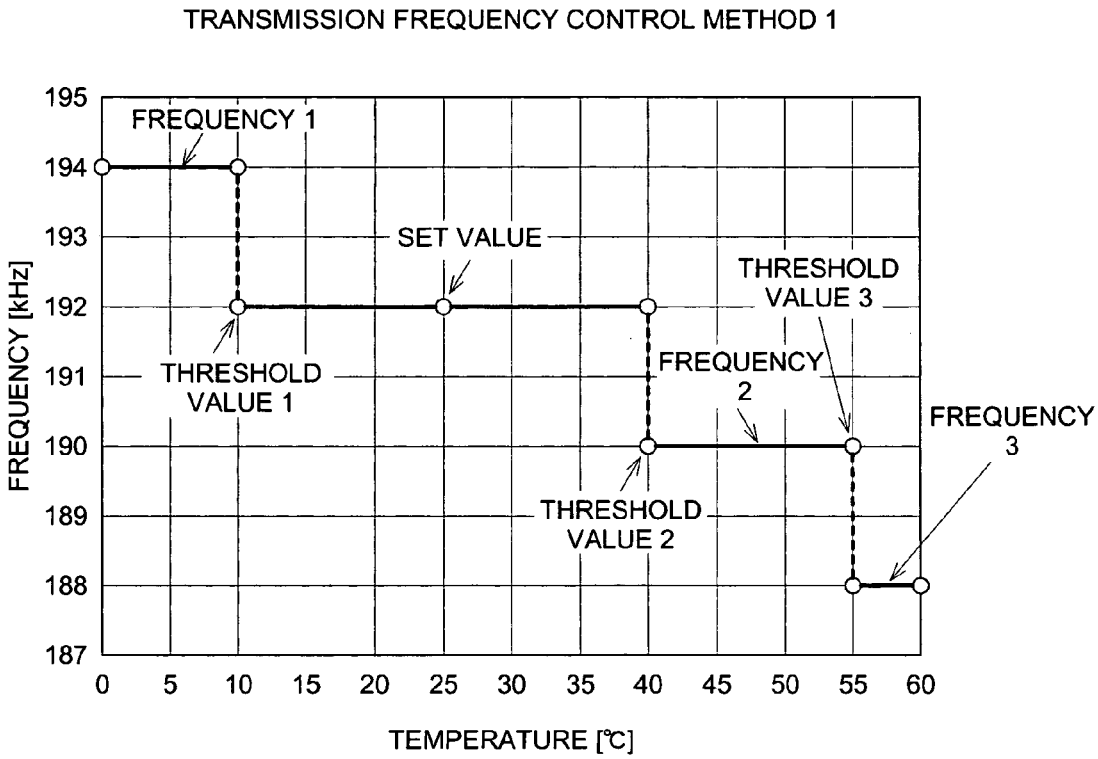
FIG. 4 is a drawing representing a first exemplary transmission frequency control method.

FIG. 4 is a drawing representing an exemplary transmission frequency control procedure based on the stepwise method. As shown in FIG. 4, four temperature ranges may be defined by three temperature threshold values (threshold values T1, T2 and T3). The transmission frequencies corresponding to these four temperature ranges may then be set. For example, frequency 1 is set for the temperature range equal to or lower than threshold value T1. The preset frequency value may then be set for temperatures between the threshold values T1 and T2. Frequency 2 is set for the range higher than threshold value T2 and equal to or lower than T3, and the frequency 3 is set the range higher than threshold value T3. The control section 10 compares the temperature detected by the temperature sensor 18, with the temperatures of threshold values T1, T2 and T3, and determines the range of the detected temperature. Then the control section 10 may control the transmission circuit 31 in such a way that transmission will be carried out at the frequency corresponding to that temperature range.

Figure 5:
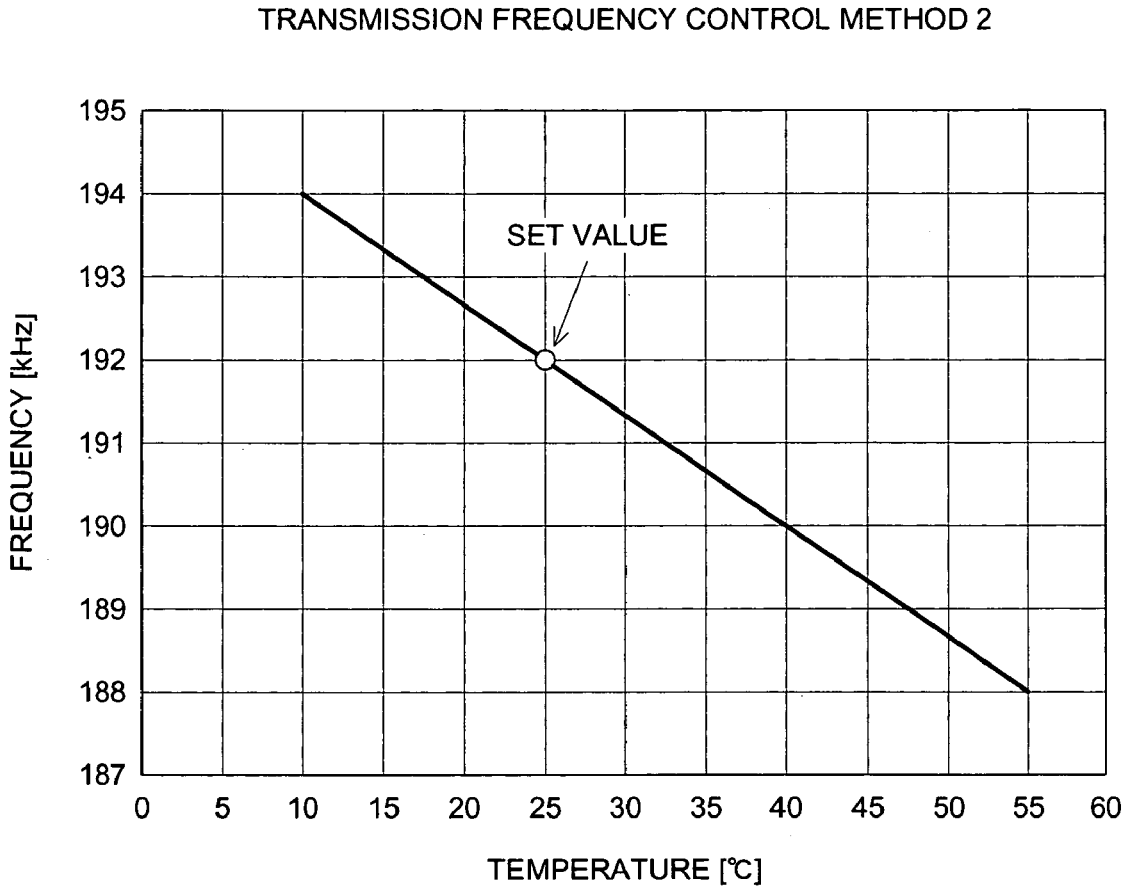
FIG. 5 is a diagram representing a second exemplary transmission frequency control method.

FIG. 5 is a diagram representing an exemplary transmission frequency control method based on the linear procedure. As shown in FIG. 5, the transmission frequency control method based on the linear procedure may be expressed in a linear representation of the relationship between the temperature and frequency. In this case, the control section 10 changes the transmission frequency of the ultrasonic transmitter in conformity to the result of detection by the temperature sensor 18.

Further, the sheet feeding apparatus 100 may be provided with a sheet position detecting section 19. The sheet position detecting section 19 is equipped with a sheet position detecting sensor. The sheet position detecting sensor may be arranged on the conveyance path located before the ultrasonic sensor 16*s*. When it is detected that the sheet has reached the predetermined position, the sheet position detecting sensor may send the detection signal to the control section 10. Based on the detection signal, the control section 10 may control the timing of when the transmission frequency of the transmitter 32 of the ultrasonic sensor 16*s* is changed.

FIGS. 6(*a*) and 6(*b*) are diagrams representing an exemplary timing arrangement for switching the transmission frequency. FIG. 6(*a*) shows the case where the frequency change operation may be performed at the rise of the output signal of the sheet position detecting sensor. FIG. 6(*b*) shows the case where the frequency change operation may be performed at the fall of the output signal of the sheet position detecting sensor.

As shown in FIG. 6(*a*), frequency change operation may be performed at the rise of the output signal of the sheet position detecting sensor, and the operation is performed to detect the feed of multiple sheets of paper after the frequency has been changed.

On the other hand, as shown in FIG. 6(*b*), frequency change operation may be performed at the fall of the output signal of the sheet position detecting sensor, and the operation is performed to detect the feed of multiple sheets of paper after the frequency has been changed.

The following describes an example of the first exemplary embodiment, where detecting the feed of multiple sheets of paper by the sheet feeding apparatus 100 is performed at the rise of the output signal of the sheet position detecting sensor.

In this embodiment, when detecting the feed of multiple sheets of paper one by one from the predetermined storage position, the temperature inside the apparatus may be measured. Based on the result of temperature measurement, the temperature range may be determined by comparison with the threshold value of the temperature range. Then transmission (e.g., of the continuously driven ultrasonic sensor 16*s*) is then performed at the transmission frequency corresponding to this temperature range, and the feed of multiple sheets of paper may be detected. This is the assumption for the following description.

Figure 7:
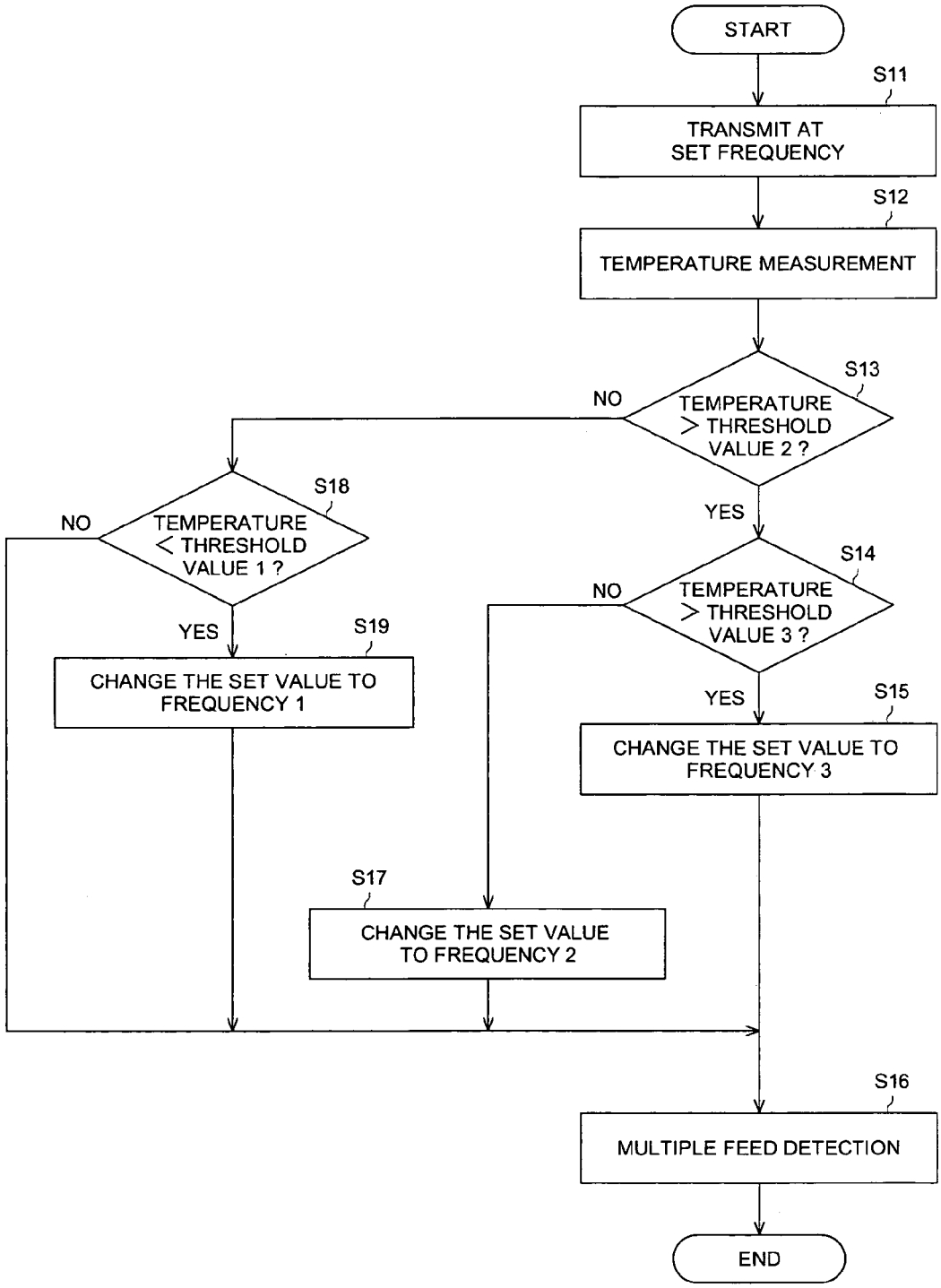
FIG. 7 is a drawing showing an example of operations at the time of detecting the feed of multiple sheets of paper by the sheet feeding apparatus 100.

Based on the aforementioned assumption, in the Step S11 in the exemplary flowchart of FIG. 7, transmission may be carried out at the previously set frequency value. In this case, transmission is performed at the frequency determined in advance at the time of starting the detection of the feed of multiple sheets of paper. Then in Step S12, temperature is measured. In Step S13, a check is made to determine whether or not the detected temperature is greater than threshold value T2. If the detected temperature has been determined to be greater than threshold value T2, a check is made in the Step S14 to determine whether or not the detected temperature is greater than threshold value T3. If the detected temperature has been determined to be greater than threshold value T3, the set frequency is changed to frequency 3 in Step S15. In this case, the frequency is changed based on the result of detection by the sheet position detecting section 19 before starting the detection of the feed of multiple sheets of paper. The operation terminates after detecting the feed of multiple sheets of paper in Step 16.

When it has been determined in Step S14 that the detected temperature is not greater than threshold value T3, the set frequency is changed to frequency 2 in Step S17. In this case, the frequency is changed based on the result of detection by the sheet position detecting section 19 before starting the detection of the feed of multiple sheets of paper. The operation terminates after detecting the feed of multiple sheets of paper in Step S16.

When it has been determined in Step S13 that the detected temperature is not greater than threshold value T2, a check is made in Step 18 to determine whether or not the detected temperature is less than or equal to threshold value T1. If the detected temperature has been determined to be T1 or less, the set frequency is changed to frequency 1 in Step S19, and the feed of multiple sheets of paper is detected in Step S16. When it has been determined in Step 18 that the detected temperature is not T1 or less, the feed of multiple sheets of paper is detected in Step S16, without the frequency being changed, and then operation terminates.

The above description has referred to the exemplary case where the temperature changes from the initially set value and the frequency may be changed from the set value to frequency corresponding to the detected temperature. However, for example, when the temperature is changed from high to low level during the use of the sheet feeding apparatus, the frequency can be changed from a lower frequency (frequency 2 or 3) to the preset frequency value.

In the frequency control method based on linear procedure, the linear relationship between the temperature and transmission frequency may be set and stored in advance. Based on the temperature detection signal of the temperature sensor 18, the control section 10 refers to the relationship between the temperature and transmission frequency. If the detected temperature is higher than the preset value, the frequency may be reduced. When the detected temperature is lower than the set level, the frequency may be increased. In this case, the frequency may be changed based on the result of detection by the sheet position detecting section 19 before starting the detection of the feed of multiple sheets of paper.

In the present embodiment, the present invention may be equipped with an on/off operation control section 17 for turning on or off the multiple feed detecting section 16 which detects the feed of multiple sheets of paper; a temperature sensor 18 for measuring the temperature inside the apparatus; and a sheet position detecting section 19. A plurality of temperature ranges may be specified in advance and the transmission frequency of the transmitter 32 with respect to each temperature range may be set and stored. When detecting the feed of multiple sheets of paper, the temperature inside the apparatus may be measured. The control section 10 may compare the temperature detected by the temperature sensor 18, with temperatures of threshold values T1, T2 and T3, and determine the range of the temperature. Then the control section 10 may control the transmission circuit 31 in such a way that transmission will be carried out at the frequency corresponding to that temperature range.

This arrangement allows a change of the transmission/reception sensitivity of the ultrasonic transmitter 32 and receiver 33 due to temperature change to be corrected by transmission frequency control. This avoids incorrect detection of the feed of multiple sheets of paper and ensures multiple sheet feed detection with a stable detection accuracy. The invention may achieve these advantages even in an installation site where there is a drastic temperature change, for example, inside the copying machine, and the sensitivity is affected due to the temperature characteristics of the ultrasonic sensor 16*s*. In connection with or apart from the temperature change of installation site due to the fixing heat, the temperature of the ultrasonic wave sensor may widely change when the sensor has been driven for a relatively long period. For instance, when the temperature of the sensor may rise during a copy job in which a number of copies are successively produced. The above may apply particularly when the sensor 16*s* is continuously driven.

Since the multiple feed detecting section 16 can be arranged inside the apparatus, generation of waste paper as in the prior art can be avoided.

Since transmission frequency is controlled when the multiple feed detecting section 16 is not working, stable detection is ensured. Further, because an on/off operation control section 17 may control on/off operations of the multiple feed detecting section 16, incorrect operation of the multiple feed detecting section 16 may be prevented by turning off the multiple feed detecting section 16 when the detected temperature is outside the operation range of the multiple feed detecting section 16. Further, the sheet feeding apparatus may be provided with a selecting section for selecting release of the multiple feed detection by the multiple feed detecting section 16. This may permit the user to select the use of the multiple feed detecting function whenever required.

Figure 8:
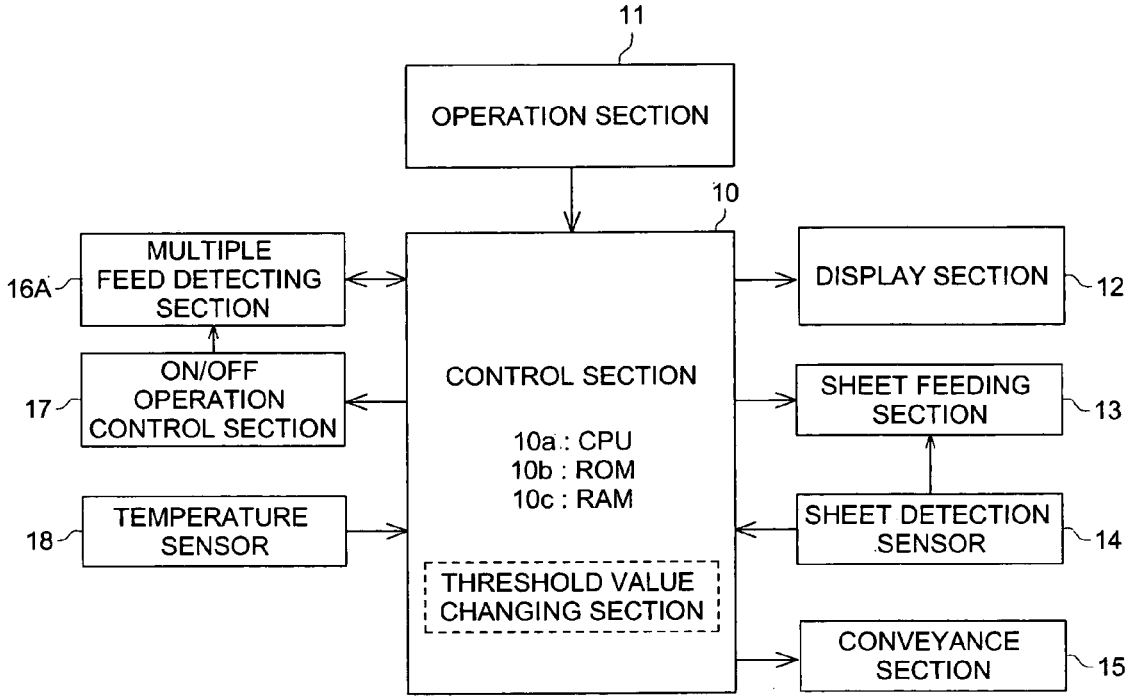
FIG. 8 is a drawing representing an example of the configuration of a sheet feeding apparatus 200 as a second embodiment of the present invention.

The following describes a sheet feeding apparatus consistent with a second embodiment of the present invention. FIG. 8 is a drawing representing an example of the configuration of the sheet feeding apparatus 200.

The sheet feeding apparatus 200 shown in FIG. 8 may include a control section 10, an operation section 11, a display section 12, a sheet feeding section 13, a sheet detection sensor 14, a conveyance section 15, a multiple feed detecting section 16A, and a temperature sensor 18.

The control section 10 may further include a CPU 10*a*, ROM 10*b* and RAM 10*c*. The RAM 10*c* may be used as a work memory area for the program stored in the ROM 10*b* as the CPU 10*a* controls the entire operation of the sheet feeding apparatus 200.

Based on the multiple feed detection information gained by the multiple feed detecting section 16A, the control section 10 may control the conveyance section 15. For example, when the multiple sheet feed has been detected, the conveyance section 15 may be controlled by the control section 10 in such a way as to form a predetermined image indicating the occurrence of multiple feed and to eject the multiple fed sheets. At the same time, the control section 10 may retain the image data associated with the multiple feed sheets, and control the image forming section (FIG. 2) so that an image may be formed on the next sheet of paper conveyed by the conveyance section 15, in conformity to this image data. Further, when multiple sheets of paper has been fed, control may be provided in such a way that the image formation operation is stopped after the multiple fed sheets have been ejected to the predetermined ejection tray, and a message is displayed on the display section 12 to notify that multiple sheets have been fed.

In this embodiment, the control section 10 may also serve as a threshold value change section. In this case, the control section 10 changes the threshold value for multiple feed decision, according to the result of detection by the temperature sensor 18. The multiple feed determining threshold value may thus be changed in response to the amount of temperature change with respect to the initial temperature. The other elements of FIG. 8 operate the same as described above with respect to FIG. 1.

The multiple feed detecting section 16A uses ultrasonic waves to detect the feed of multiple sheets of paper. The multiple feed detecting section 16A may be equipped with an ultrasonic sensor 16*s* consisting of an ultrasonic transmitter and receiver. As shown in FIG. 2, the ultrasonic sensor 16*s* may be arranged on the sheet conveyance path 24 for conveying the paper located before the image forming section. Further, an exemplary configuration of the multiple feed detecting section 16A and detection of the feed of multiple sheets of paper are illustrated in FIGS. 3 and 9.

Figure 9:
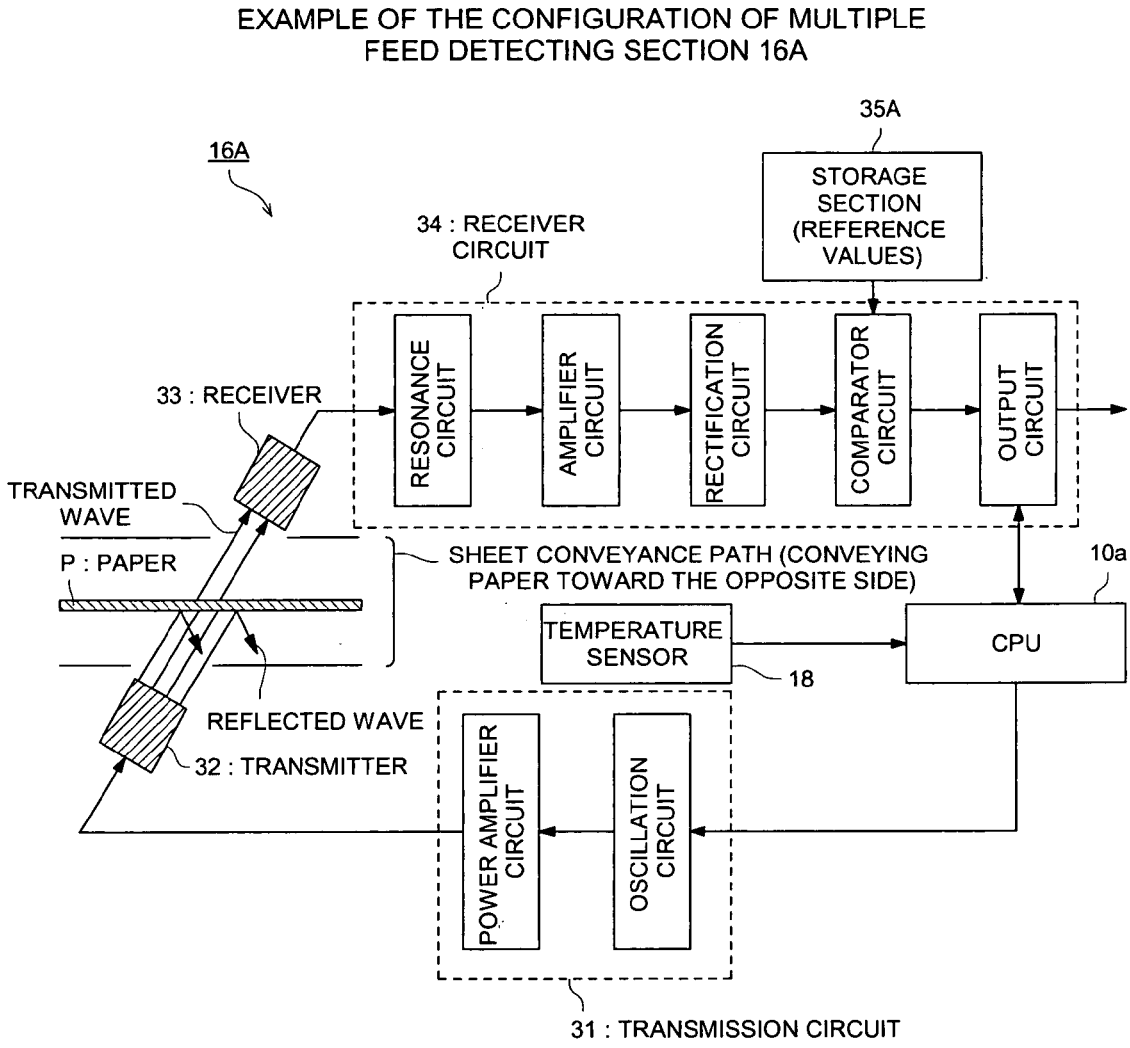
FIG. 9 is a drawing representing an example of the configuration of a multiple feed detecting section 16.

While almost of the exemplary configuration of the multiple feed detecting section 16A shown in FIG. 9 is same as that of the multiple feed detecting section 16 shown in FIG. 3, the storage section 35A stores a plurality of reference values (the multiple feed determining threshold values) and temperature ranges respectively corresponding to the reference values.

In this second embodiment, the control section 10 can select one of the reference values of the storage section 35, and can change the selected reference value with different one of the reference value with reference to the temperature detected by the temperature sensor 18.

Figure 10:
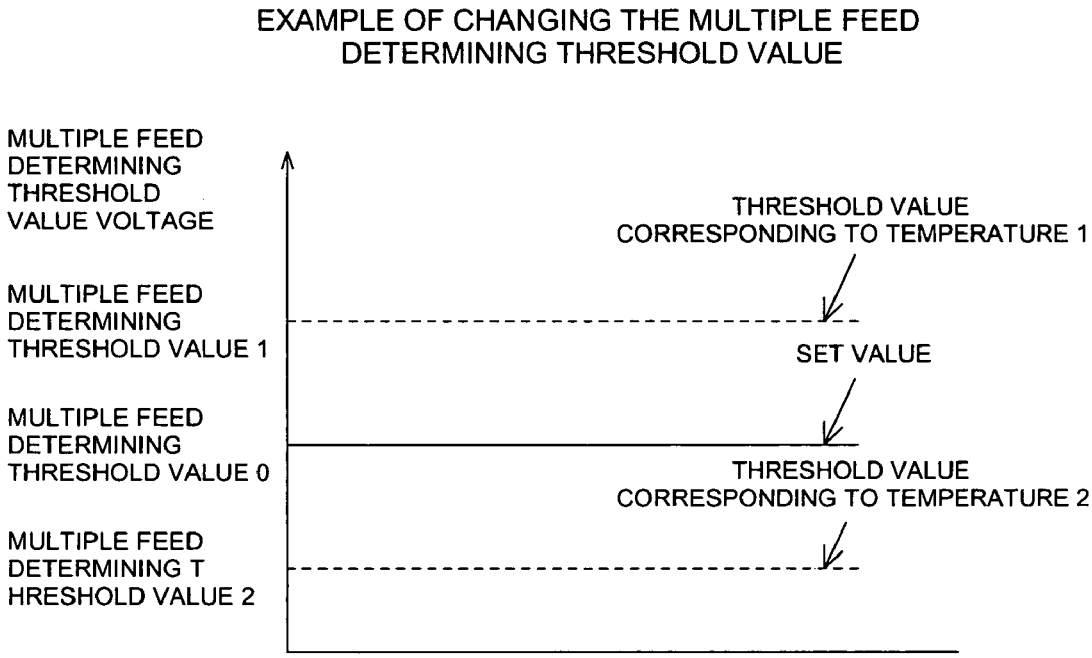
FIG. 10 is a diagram showing an example of changing the multiple feed determining threshold value.

FIG. 10 is a diagram showing an example of changing the multiple feed determining threshold value. As shown in FIG. 10, the multiple feed determining threshold value 0 may be preset with respect to the initial temperature. Based on the result of detection by the temperature sensor 18, the multiple feed determining threshold value may be changed. For example, in the case of temperature 1, the multiple feed determining threshold value may be increased (that is, to multiple feed determining threshold value 1), and in the case of temperature 2, the multiple feed determining threshold value is reduced (that is, to multiple feed determining threshold value 2).

In the aforementioned configuration of the present embodiment, the control section 10 as a threshold value changing section may be equipped with a multiple feed detecting section 16, and a temperature sensor 18 for measuring the temperature in the apparatus. When detecting the feed of multiple sheets of paper, the temperature in the apparatus may be measured first. Based on the result of temperature measurement, the threshold value for multiple feed determination may be changed to detect the feed of multiple sheets of paper.

This arrangement prevents incorrect detection of multiple feed, and ensures multiple sheet feed detection with a stable detection accuracy, even in an installation site where there is a drastic temperature change, as inside a copying machine and where the sensitivity is affected due to the temperature characteristics of the ultrasonic sensor.

Since the multiple feed detecting section 16 can be arranged inside the apparatus, generation of waste paper as in the prior art can also be avoided.

Since multiple feed determining threshold value may be changed when the multiple feed detecting section 16A is not working, stable detection is ensured. Further, since control section 10 may control through an on/off operation control section on/off operations of the multiple feed detecting section 16A, incorrect operation of the multiple feed detecting section 16A is prevented by turning off the multiple feed detecting section 16A when the detected temperature is outside the operation range of the multiple feed detecting section 16A. Further, the sheet feeding apparatus may be provided with a selecting section for selecting release of the multiple feed detection by the multiple feed detecting section 16A. This permits the user to select the use of the multiple feed detecting function whenever required.

In the aforementioned embodiment, the sheet feeding apparatuses 100 and 200 are applied to the copying machine. Without being restricted thereto, this invention is also applicable to other types of sheet feeding apparatuses.

In the aforementioned embodiment, the on/off operation status of the multiple feed detecting section is displayed on the display section 12. Without being restricted thereto, it is also possible to make such arrangements that a buzzer or light is used to notify the user of the on/off operation status of the multiple feed detecting section.

In the aforementioned embodiment, the temperature sensor may be used to measure the temperature inside the sheet feeding apparatus 100 or 200, without the prevent invention being restricted thereto. For instance, as mentioned above, the temperature sensor may directly sense the temperature of the ultrasonic wave sensor.

In the aforementioned first embodiment, four temperature ranges are arranged, without the prevent invention being restricted thereto.

The description of the aforementioned first embodiment refers to two exemplary types of the transmission frequency control method, the stepwise and linear methods, but the present invention is not restricted to these two control methods.

The foregoing has described principles, preferred embodiments and modes of operation of the invention. However, the invention should not be construed as being limited to the particular embodiments discussed. Thus, the above-described embodiments should be regarded as illustrative rather than restrictive, and it should be appreciated that variations may be made in those embodiments by workers skilled in the art without departing from the scope of the invention as defined by the following claims and equivalents thereof.

What is claimed is:

1. A sheet feeding apparatus, comprising:

a multiple feed detecting section having an ultrasonic transmitter, an ultrasonic receiver arranged on opposite sides of a conveyance path for conveying multiple sheets, and a comparison section, the multiple feed detecting section detecting a feed of the multiple sheets, the ultrasonic transmitter transmitting an ultrasonic wave to the ultrasonic receiver through at least one sheet traveling along the conveyance path for detecting the feed of the multiple sheets, and the comparison section comparing the ultrasonic wave received by the ultrasonic receiver with a reference level;

a temperature detecting section for detecting a temperature of the apparatus; and a control section for adjusting a detecting condition of the multiple feed detecting section based on the detected temperature.

2. The sheet feeding apparatus as claimed in claim 1, wherein the control section changes, based on the detected temperature, a transmission frequency of the ultrasonic transmitter of the multiple feed detecting section.

3. The sheet feeding apparatus of claim 2, wherein the control section selectively sets one of a plurality of predetermined transmission frequencies respectively corresponding to a plurality of temperature ranges, based on the detected temperature.

4. The sheet feeding apparatus of claim 2, further comprising:

a conveyance section for conveying the at least one sheet; and a sheet position detecting section for detecting the position of the at least one sheet being conveyed, wherein the control section adjusts the transmission frequency based on the position detected by the sheet position detecting section.

5. The sheet feeding apparatus of claim 4, wherein the control section changes the transmission frequency when the multiple feed detecting section is malfunctioning.

6. The sheet feeding apparatus of claim 4, wherein the control section adjusts the transmission frequency at a start of a signal outputted from the sheet position detecting section.

7. The sheet feeding apparatus of claim 4, wherein the control section adjusts the transmission frequency at an end of a signal outputted from the sheet position detecting section.

8. The sheet feeding apparatus of claim 2, wherein the ultrasonic transmitter is continuously driven.

9. The sheet feeding apparatus of claim 1, wherein, based on the detected temperature, the control section changes the reference level.

10. The sheet feeding apparatus of claim 9, wherein the control section changes the reference level according to a change in temperature with respect to an initial temperature.

11. The sheet feeding apparatus of claim 1, further comprising:

a selecting section for selecting release of the multiple feed detection by the multiple feed detecting section.

12. The sheet feeding apparatus of claim 1, further comprising:

an on/off operation control section for controlling on/off operations of the multiple feed detecting section, wherein the on/off operation control section turns off the multiple feed detecting section when the temperature detected by the temperature detecting section is outside a temperature range.

13. The sheet feeding apparatus of claim 12, wherein the temperature range is an operating range designed for the multiple feed detecting section.

14. The sheet feeding apparatus of claim 12, further comprising:

a notification section for notifying a user of the on/off status of the multiple feed detecting section.

15. The sheet feeding apparatus of claim 1, wherein the temperature detecting section detects a temperature of at least one of the ultrasonic transmitter and the ultrasonic receiver.

16. A sheet feeding apparatus, comprising:

a multiple feed detecting section having an ultrasonic transmitter, an ultrasonic receiver arranged on opposite sides of a conveyance path for conveying multiple sheets, and a comparison section, the multiple feed detecting section detecting a feed of the multiple sheets, the ultrasonic transmitter transmitting an ultrasonic wave to the ultrasonic receiver through at least one sheet traveling along the conveyance path for detecting the feed of the multiple sheets, and the comparison section comparing the ultrasonic wave received by the ultrasonic receiver with a reference level;

a temperature detecting section for detecting a temperature of the apparatus; and an on/off operation control section for controlling on/off operations of the multiple feed detecting section, wherein the on/off operation control section turns off the multiple feed detecting section when the temperature detected by the temperature detecting section is outside a temperature range.

17. The sheet feeding apparatus of claim 16, wherein the temperature range is an operating range designed for the multiple feed detecting section.

18. The sheet feeding apparatus of claim 16, further comprising:

a notification section for notifying a user of the on/off status of the multiple feed detecting section.

19. The sheet feeding apparatus of claim 16, wherein the ultrasonic transmitter is continuously driven.

20. The sheet feeding apparatus of claim 16, wherein the temperature detecting section detects a temperature of at least one of the ultrasonic transmitter and the ultrasonic receiver.

* * * * *